US010121357B2

(12) United States Patent
Yang et al.

(10) Patent No.: US 10,121,357 B2
(45) Date of Patent: Nov. 6, 2018

(54) SYSTEMS AND METHODS OF LOCATION BASED AWARENESS OF LIFE SAFETY SENSORS

(71) Applicant: Honeywell International Inc., Morristown, NJ (US)

(72) Inventors: Bin Yang, Shanghai (CN); Xiaoguang Zhao, Shanghai (CN); Hongye Jiang, Shanghai (CN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 15/044,417

(22) Filed: Feb. 16, 2016

(65) Prior Publication Data

US 2017/0236403 A1 Aug. 17, 2017

(51) Int. Cl.

| | |
|---|---|
| ***G08B 1/08*** | (2006.01) |
| ***G08B 25/10*** | (2006.01) |
| *G08B 7/06* | (2006.01) |

(52) U.S. Cl.

CPC ..... *G08B 25/10* (2013.01); *G08B 7/066* (2013.01)

(58) Field of Classification Search

CPC ..... G08B 25/10; G08B 7/066
USPC ..... 340/539.13
See application file for complete search history.

(56) References Cited

U.S. PATENT DOCUMENTS 5,650,770 A 7/1997 Schlager et al.
8,422,987 B2 * 4/2013 Kane ..... H04W 4/90 455/404.2
2006/0035622 A1 * 2/2006 Kampel ..... A63B 29/021 455/404.2
2008/0191863 A1 * 8/2008 Boling ..... G08B 25/08 340/521
2009/0040108 A1 * 2/2009 Katz ..... G01S 19/48 342/386
2009/0170468 A1 7/2009 Kane et al.
2011/0136463 A1 * 6/2011 Ebdon ..... G01C 21/20 455/404.1
2014/0358835 A1 * 12/2014 Marti ..... G06N 5/02 706/46

(Continued)

OTHER PUBLICATIONS

Extended European search report for corresponding EP patent application 17152535.5, dated Jun. 30, 2017.

(Continued)

*Primary Examiner* — Naomi J Small
(74) *Attorney, Agent, or Firm* — Husch Blackwell LLP

(57) ABSTRACT

Systems and methods of location based awareness of life safety sensors are provided. Some methods can include detecting an ambient emergency condition, and responsive to detecting the ambient emergency condition, transmitting a wireless beacon signal, wherein a range into which the wireless beacon signal is transmitted is limited, and wherein a signal strength of the wireless beacon signal progressively decreases from a first part of the range, adjacent a source of the wireless beacon signal, to a second part of the range, displaced from the source of the wireless beacon signal. Additionally or alternatively, some methods can include receiving a wireless beacon message from a sensor device, determining the signal strength of the wireless beacon message, and based on the signal strength of the wireless beacon message, determining the range of the sensor device.

17 Claims, 4 Drawing Sheets

(56) References Cited

U.S. PATENT DOCUMENTS

| | | | | |
|---|---|---|---|---|
| 2014/0362669 | A1* | 12/2014 | Mohan | G01J 1/0219 368/11 |
| 2015/0287310 | A1 | 10/2015 | Deliuliis et al. | |
| 2015/0373521 | A1* | 12/2015 | Olesen | H04W 4/90 455/404.2 |
| 2016/0007179 | A1 | 1/2016 | Kim | |
| 2016/0189132 | A1* | 6/2016 | Cash | G06Q 20/3224 705/14.57 |
| 2017/0180948 | A1* | 6/2017 | Haverinen | H04W 4/043 |

OTHER PUBLICATIONS

Examination report from corresponding EP patent application 17152535.5, dated Feb. 23, 2018.

* cited by examiner

SYSTEMS AND METHODS OF LOCATION BASED AWARENESS OF LIFE SAFETY SENSORS

FIELD

The present invention relates generally to life safety sensors. More particularly, the present invention relates to systems and methods of location based awareness of life safety sensors.

BACKGROUND

When an ambient or life safety condition, such as smoke, carbon monoxide, or other poisonous gas, is detected by a sensor in a monitored region, such as a building or a warehouse, there are no know systems and methods to indicate to users a location of such an emergency condition within the monitored region. For example, when the sensor detects the emergency condition, the sensor may join a one-go-all-go protocol such that all sensors, detectors, sirens, or bells in the monitored region are activated to indicate to users that the emergency condition is present in the monitored region. However, the users, such as occupants of the monitored region or emergency personnel reporting to the monitored region, have no way to know the location of the emergency condition within the monitored region so as to avoid the location when exiting the monitored region or so as to find the location when arriving in the monitored region to address the emergency condition. Indeed, if one of the users in an immediate vicinity of the emergency condition could know of such a nearby alarm condition in a timely manner, then that user attempting to exit the monitored region could more effectively escape from the emergency condition, and another one of the users attempting to address the emergency condition could more effective take necessary actions.

In view of the above, there is a continuing, ongoing need for improved systems and methods.

DETAILED DESCRIPTION

Figure 1:
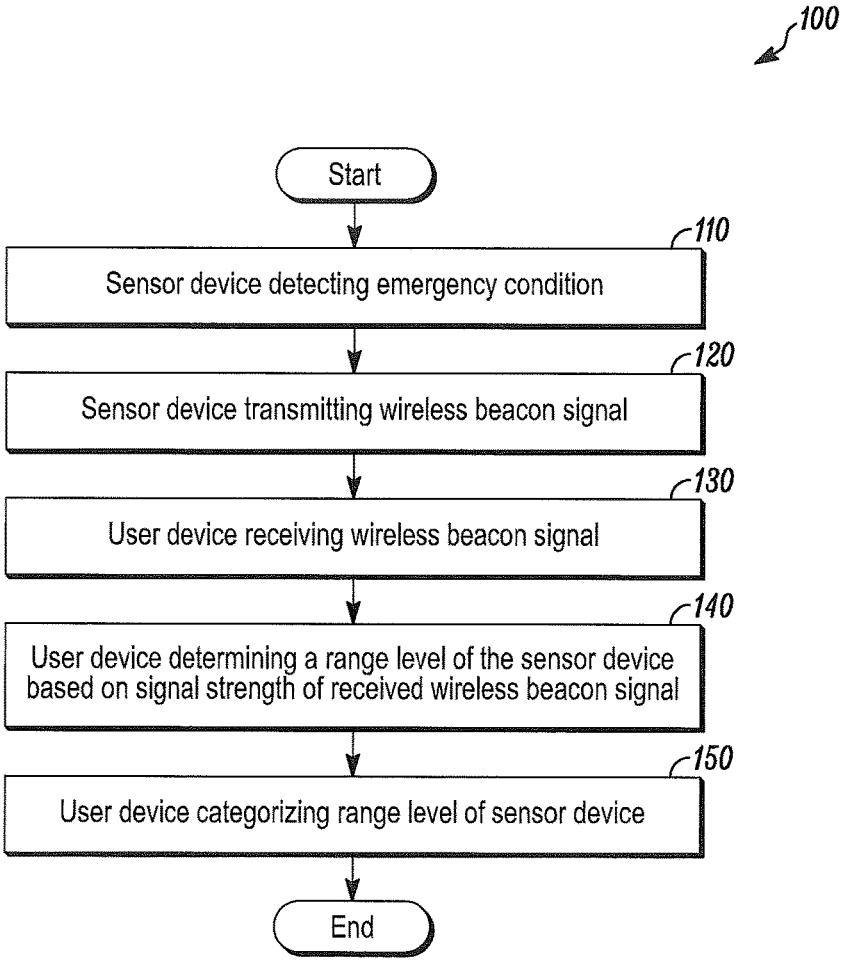
FIG. 1 is a flow diagram of a method in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include systems and methods of location based awareness of life safety sensors. For example, a sensor in accordance with disclosed embodiments can transmit a wireless beacon signal to establish a region around the sensor. In some embodiments, the wireless beacon signal can include an iBeacon signal, a Bluetooth Low Energy (BLE) advertising message, and the like. However, it is to be understood that embodiments disclosed herein are not so limited and could include any additional or alternative wireless beacon signal as would be known and desired by one of ordinary skill in the art.

Electronic user devices, such as smart phones, wearable devices, or other BLE capable devices, within a monitored region that includes the sensor as disclosed herein can receive the wireless beacon signal transmitted by the sensor. Based on a signal strength of the wireless beacon signal received, a user device can identify a range level of the sensor that transmitted the wireless beacon signal and thereby determine whether the sensor transmitting the wireless beacon signal is in an immediate, near, or far range relative to the user device.

In accordance with disclosed embodiments, when the sensor operating in a normal condition, the sensor can abstain from transmitting the wireless beacon signal. However, upon detection of an emergency condition, the sensor can enable a wireless beacon signal transmitting module for broadcasting or transmitting the wireless beacon signal. In some embodiments, the sensor can transmit the wireless beacon signal for a predetermined period of time, until the sensor fails to detect the emergency condition for a predetermined period of time after detecting the emergency condition, or until the sensor receives user input with instructions to cease transmitting the wireless beacon signal.

Electronic user devices within range of the sensor can detect and receive the wireless beacon signal advertising the sensor. Upon detection and reception, the user device can identify the range level of the sensor that transmitted the wireless beacon signal based on the signal strength of the wireless beacon signal received. The user device can also decode the wireless beacon signal to identify information advertised by the sensor, including a type of the emergency condition detected by the sensor.

It is known that wireless beacon signals, such as the BLE advertising message, have a limited range. Accordingly, when the user device detects the wireless beacon signal as disclosed herein, regardless of the range level identified, it can be understood that the user device is close to an emergency zone in which the sensor transmitting the wireless beacon signal is located. As a user moves throughout the monitored region, either to avoid the emergency zone, to exit the monitored region, or to enter the emergency zone to address the emergency condition, the user can determine his location relative to the emergency zone or the sensor that detected the emergency condition according to whether the user's electronic device receives a the wireless beacon message and, further, the range level of the wireless beacon message received. When the user is trying to avoid the emergency zone or to exit the monitored region, the user can understand that he should try a different route or go in another direction when he receives the wireless beacon signal with any range level. However, when the user is trying to enter the emergency zone to address the emergency condition, the user can assess the range level of the wireless beacon signal received to determine whether he is far, near, or immediate relative to the emergency zone and whether he should move along a same route or in a same direction as he becomes nearer or more immediate to the emergency zone.

FIG. 1 is a flow diagram of a method 100 in accordance with disclosed embodiments. As seen in FIG. 1, the method 100 can include a sensor device detecting an emergency condition as in 110 and, responsive thereto, transmitting a wireless beacon signal as in 120. The method 100 can also include a user device within range of the sensor device receiving the wireless beacon signal as in 130 and, responsive thereto, determining a range level of the sensor device based on a signal strength of the wireless beacon signal received as in 140. The method 100 can also include the user device categorizing the range level of the sensor device as in 150, for example, as immediate, near, or far and, in some embodiments, providing a notification to a user thereof.

Figure 2:
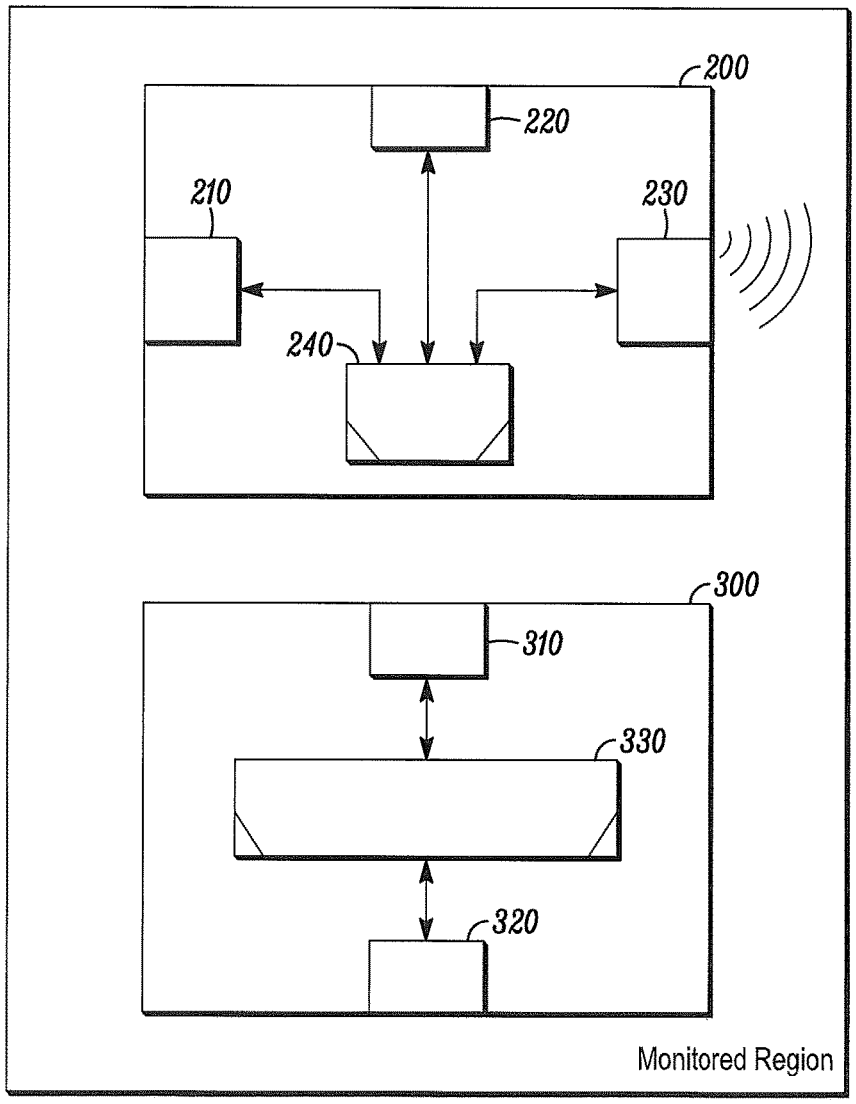
FIG. 2 is a block diagram of a system in accordance with disclosed embodiments.

FIG. 2 is a block diagram of a system in accordance with disclosed embodiments. As seen in FIG. 2, the system can include a sensor device 200 and a user device 300 in a monitored region.

The sensor device 200 can include a detection module 210, a wired or wireless alarm reporting module 220, and a wireless beacon signal transceiver 230, each of which can be in bidirectional communication with a microcontroller unit 240. It is to be understood that the microcontroller unit 240 can include control circuitry, one or more programmable processors, and executable control software as would be understood by those of ordinary skill in the art. The executable control software can be stored on a transitory or non-transitory computer readable medium, including, but not limited to local computer memory, RAM, optical storage media, magnetic storage media, flash memory, and the like. In some embodiments, the microcontroller unit 240, including the control circuitry, the programmable processors, and the executable control software can execute and control some of the methods describe above and herein.

For example, when the detection module 210 detects an emergency condition, the microcontroller unit 240 can report an alarm via the wired or wireless alarm reporting module 220 and activate the wireless beacon signal transceiver 230 for transmission of a wireless beacon message. In some embodiments, the wireless beacon message can include information related to the sensor device 200 or the emergency condition detected by the detection module 210.

Similarly, the user device 300 can include a wireless beacon signal transceiver 310 and a user interface device 320, each of which can be in bidirectional communication with a microcontroller unit 330. It is to be understood that the microcontroller unit 330 can include control circuitry, one or more programmable processors, and executable control software as would be understood by those of ordinary skill in the art. The executable control software can be stored on a transitory or non-transitory computer readable medium, including, but not limited to local computer memory, RAM, optical storage media, magnetic storage media, flash memory, and the like. In some embodiments, the microcontroller unit 330, including the control circuitry, the programmable processors, and the executable control software can execute and control some of the methods describe above and herein.

For example, when the wireless beacon signal transceiver 310 detects a wireless beacon signal transmitted by the sensor device 200, the microcontroller unit 330 can identify a signal strength of the wireless beacon signal received and, based thereon, determine a range of the sensor device 200 and categorize the range determined, for example, as immediate, near, or far. In some embodiments, the microcontroller unit 330 can decode the wireless beacon signal received to identify the information about the sensor device 200 or the emergency condition detected by the sensor device 200. In some embodiments, the user interface device 320 can display or emit an indication to a user regarding the range of the sensor device 200 determined.

Figure 3:
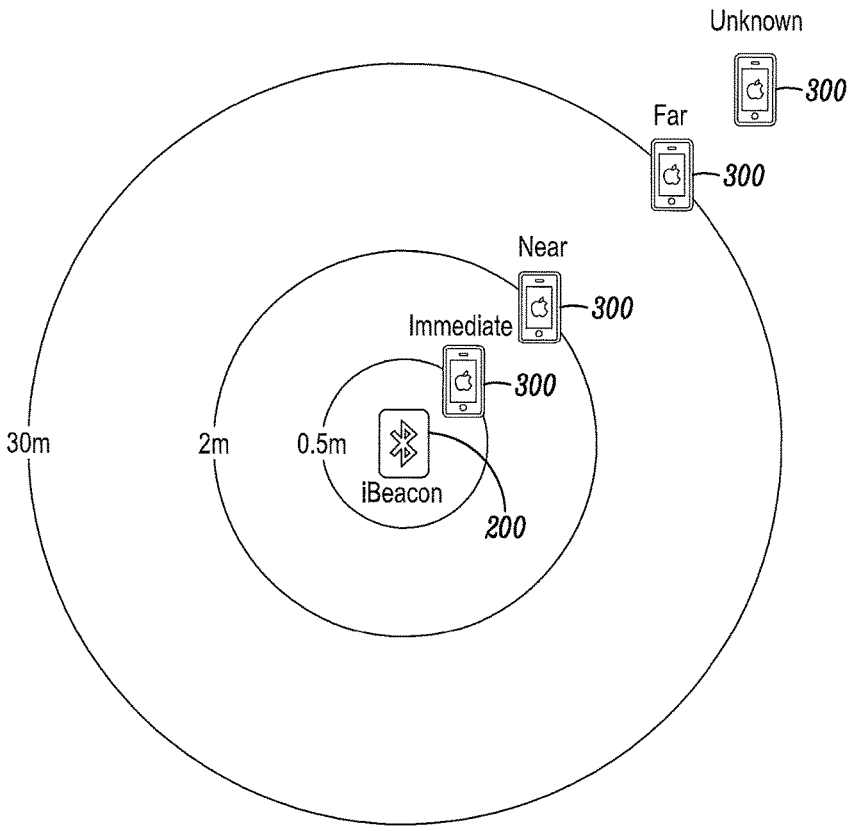
FIG. 3 is a block diagram of a sensor device and user devices in immediate, near, far, and unknown ranges of the sensor device in accordance with disclosed embodiments.

FIG. 3 is a block diagram of the sensor device 200 and user devices 300 in immediate, near, far, and unknown ranges of the sensor device 200. For example, the signal strength of the wireless beacon signal received by the user device 300 in the immediate range of the sensor device 200 can be highest and representative of the user device 300 being physically very close to the sensor device 200. The signal strength of the wireless beacon signal received by the user device 300 in the near range of the sensor device 200 can be the next highest and representative of the user device 300 being within a clear line of sight of the sensor device 300. The signal strength of the wireless beacon signal received by the user device 300 in the far range of the sensor device 200 can be the lowest and representative of the user device 300 not being physically near the sensor device 200 or an obstruction existing between the sensor device 200 and the user device 300 that causes attenuation of the wireless beacon signal. In some embodiments, the signal strength of the wireless beacon signal received by the user device 300 in the far range of the sensor device 200 can also be representative of low confidence in any accuracy of location detection. Finally, the signal strength of the wireless beacon signal received by the user device 300 in an unknown range may be unable to be determined and representative of a detectable range just beginning or of insufficient signal measurements to determine the range.

Figure 4:
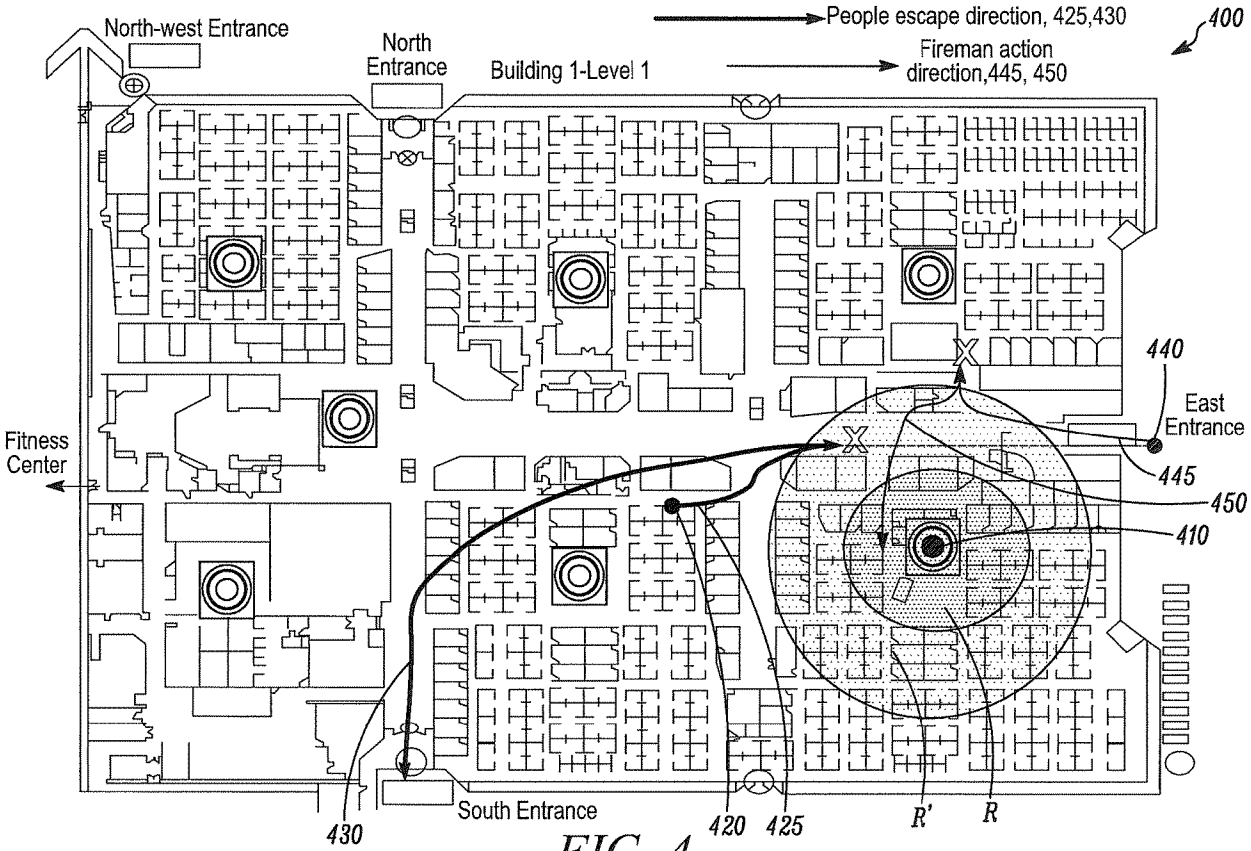
FIG. 4 is a floor plan of a monitored region in accordance with disclosed embodiments.

FIG. 4 is a floor plan 400 of a monitored region in accordance with disclosed embodiments. As seen in FIG. 4, a sensor 410 in the monitored region that detects an emergency condition can transmit an alarm signal and a wireless beacon signal with ranges R and R'. A signal strength of the alarm signal in the range R can be higher than the signal strength of the alarm signal in the range R'. The floor plan 400 and paths 425, 430, 445, 450 shown thereon are illustrative of users 420, 440, such as occupants exiting the monitored region and emergency personnel entering the monitored region to address the emergency condition detected, effectively traversing the monitored region to avoid or approach the sensor 410 that detected the emergency condition.

For example, upon hearing the alarm signal, the user 420 in the monitored region can try to exit the monitored region via the East Entrance along the path 425. However, as the user 420 moves along the path 425, an electronic device of the user 420 can enter the range R' of the sensor 410 and receive the wireless beacon signal transmitted by the sensor 410. Upon receipt of the wireless beacon signal, the user 420 can change direction and exit the monitored region via the South Entrance along the path 430. While traversing the path 430, the electronic device of the user 420 does not receive the wireless beacon signal so the user 420 can understand that he is always a relatively safe distance away from the emergency condition detected by the sensor 410.

Conversely, emergency personnel 440 can enter the monitored region via the East Entrance and try to locate the sensor 410 by traversing the path 445. However, as the emergency personnel 440 moves along the path 445, the electronic device of the emergency personnel 440 can enter and then exit the range R' of the sensor 410 and, accordingly, receive and then stop receiving the wireless beacon signal transmitted by the sensor 410. Upon exiting the range R' of the sensor 410 and failing to receive the wireless beacon signal transmitted by the sensor 410, the emergency personnel 440 can change direction and traverse the path 450 so that the electronic device of the emergency personnel 440 reenters the range R' of the sensor 410 and then the range R of the sensor 410 and, accordingly, receives the wireless beacon signal transmitted by the sensor 410 with the signal strength at a progressively higher level. Accordingly, the emergency personnel 440 can understand that he is moving in the right direction and getting closer to the emergency condition detected by the sensor 410.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

an electronic device receiving a wireless beacon signal transmitted by a sensor responsive to the sensor detecting an ambient emergency condition;

the electronic device identifying a range level of the sensor based on a signal strength of the wireless beacon signal;

the electronic device determining a category of the range level as immediate, near, or far relative to the electronic device;

when the electronic device is operating under a first user type and the category of the range level is far, the electronic device directing a user of the electronic device to change directions towards the sensor; and when the electronic device is operating under a second user type and the category of the range level is immediate, near, or far, the electronic device directing the user of the electronic device to change directions away from the sensor, wherein a range into which the wireless beacon signal is transmitted is limited, and wherein the signal strength of the wireless beacon signal progressively decreases from a first part of the range, adjacent the sensor, to a second part of the range, displaced from the sensor.

2. The method of claim 1, wherein the wireless beacon signal includes a Bluetooth Low Energy advertising message.

3. The method of claim 1, further comprising the electronic device failing to receive the wireless beacon signal prior to the sensor detecting the ambient emergency condition.

4. The method of claim 1 further comprising the electronic device failing to receive the wireless beacon signal after the sensor fails to detect the ambient emergency condition for a predetermined period of time after detecting the ambient emergency condition.

5. The method of claim 1 further comprising:

the electronic device receiving user input; and responsive to the user input, the electronic device transmitting instructions to the sensor to cease transmitting the wireless beacon signal.

6. The method of claim 1, wherein the wireless beacon signal includes information about the sensor.

7. The method of claim 1, wherein the wireless beacon signal includes information about the ambient emergency condition.

8. The method of claim 1, further comprising reporting the ambient emergency condition to an alarm monitoring system.

9. A method comprising:

an electronic device detecting and receiving a wireless beacon signal from a sensor device;

the electronic device determining a signal strength of the wireless beacon signal;

based on the signal strength of the wireless beacon signal, the electronic device determining a range of the sensor device;

the electronic device determining a category of the range as immediate, near, or far relative to the electronic device;

when the electronic device is operating under a first user type and the category of the range is far, the wireless beacon signal instructing the electronic device to change directions towards the sensor device; and when the electronic device is operating under a second user type and the category of the range is immediate, near, or far, the wireless beacon signal instructing the electronic device to change directions away from the sensor device, wherein the signal strength of the wireless beacon signal progressively decreases from a first part of the range, adjacent the sensor device, to a second part of the range, displaced from the sensor device.

10. The method of claim 9, wherein the wireless beacon signal includes a Bluetooth Low Energy advertising message.

11. The method of claim 9 further comprising failing to receive the wireless beacon signal outside of the range.

12. The method of claim 9 further comprising decoding the wireless beacon signal to identify additional information about the sensor device.

13. The method of claim 9 further comprising decoding the wireless beacon signal to identify additional information about an ambient emergency condition detected by the sensor device.

14. The method of claim 9 further comprising the electronic device displaying or emitting a notification message indicative of the range.

15. A system comprising:

a sensing device; and an electronic device, wherein, responsive to the sensing device detecting an ambient emergency condition, the sensing device transmits a wireless beacon signal into a limited range for detection by the electronic device, wherein a signal strength of the wireless beacon signal progressively decreases from a first part of the limited range, adjacent the sensing device, to a second part of the limited range, displaced from the sensing device, wherein the electronic device receives the wireless beacon signal, identifies a range level of the sensing device based on a signal strength of the wireless beacon signal, and determines a category of the range level as immediate, near, or far relative to the electronic device, wherein, when the electronic device is operating under a first user type and the category of the range level is far, the wireless beacon signal directs the electronic device to change directions towards the sensing device, and wherein, when the electronic device is operating under a second user type and the category of the range level is immediate, near, or far, the wireless beacon signal directs the electronic device to change directions away from the sensing device.

16. The system of claim 15, wherein the wireless beacon signal includes a Bluetooth Low Energy advertising message.

17. The system of claim 15, wherein the sensing device abstains from transmitting the wireless beacon signal prior to detecting the ambient emergency condition.

* * * * *